United States Patent [19]

Berges

[11] Patent Number: 5,046,934

[45] Date of Patent: Sep. 10, 1991

[54] TWIN SHAFT VACUUM PUMP WITH PURGE GAS INLET

[75] Inventor: Hanns-Peter Berges, Cologne, Fed. Rep. of Germany

[73] Assignee: Leybold Aktiengesellschaft, Fed. Rep. of Germany

[21] Appl. No.: 481,853

[22] Filed: Feb. 20, 1990

[51] Int. Cl.[5] ..... F04C 29/00; F04C 23/00

[52] U.S. Cl. ..... 418/97; 418/200; 418/206

[58] Field of Search ..... 418/9, 15, 97, 200, 418/205, 206

[56] References Cited

FOREIGN PATENT DOCUMENTS 338764 10/1989 European Pat. Off. ..... 418/9

2111126 6/1983 United Kingdom ..... 418/200

2168759 6/1986 United Kingdom ..... 418/15

*Primary Examiner*—Leonard E. Smith

*Assistant Examiner*—David L. Cavanaugh

*Attorney, Agent, or Firm*—Hill, Van Santen, Steadman & Simpson

[57] ABSTRACT

A twin-shaft vacuum pump including a rotor pair mounted for rotation in a pump chamber. The rotor pair together with the chamber wall define a suction side and delivery side of the pump chamber. In order to prevent solid particles suspended in pump fluid from settling in the chamber, the invention provides a flushing gas outlet orifice disposed on the delivery side of the pump chamber and adapted to be connected to a source of flushing gas. The solid particles can thus be held in suspension and conveyed from the pump with the assistance of flushing gas supplied through the orifice.

5 Claims, 1 Drawing Sheet

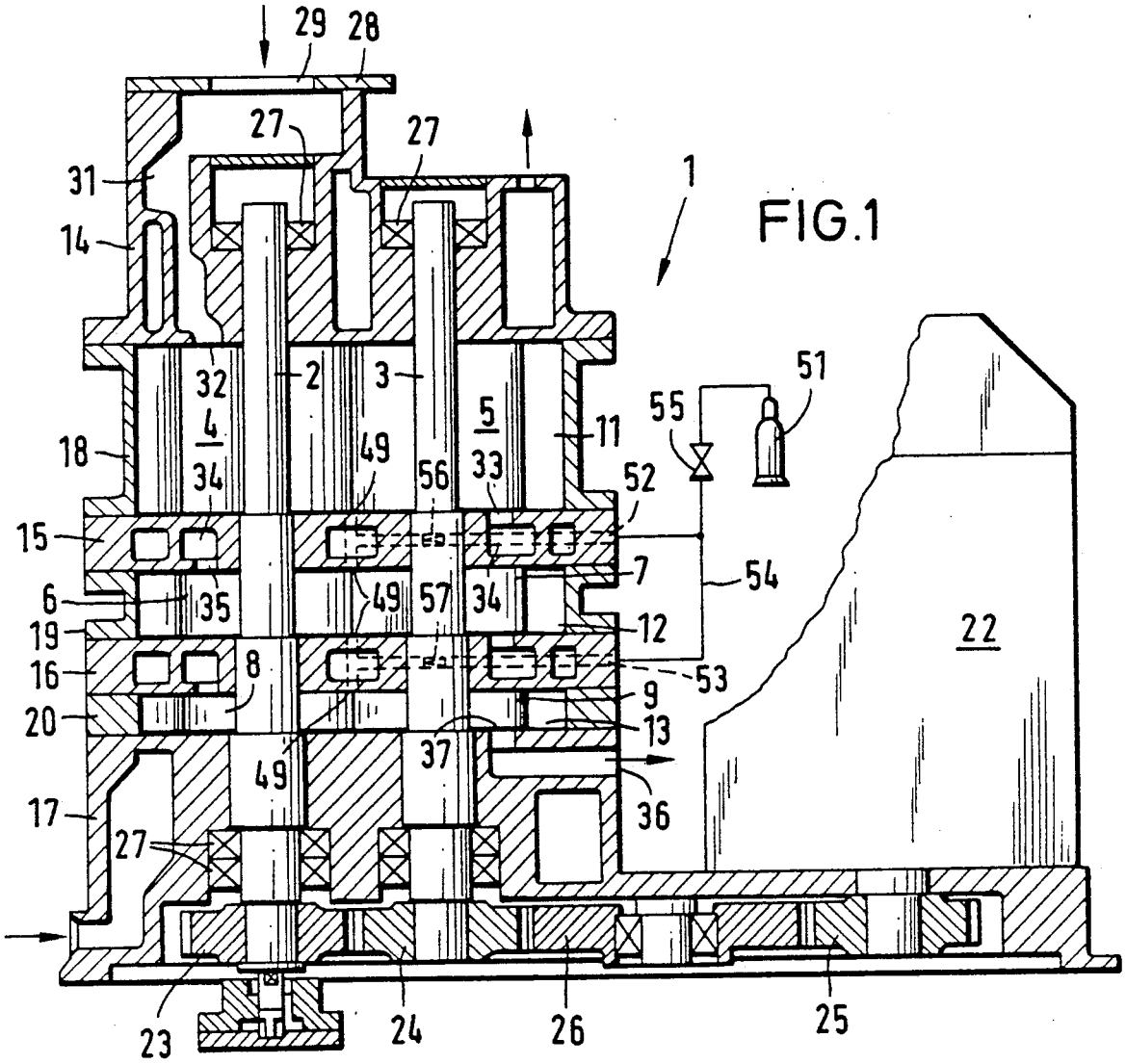
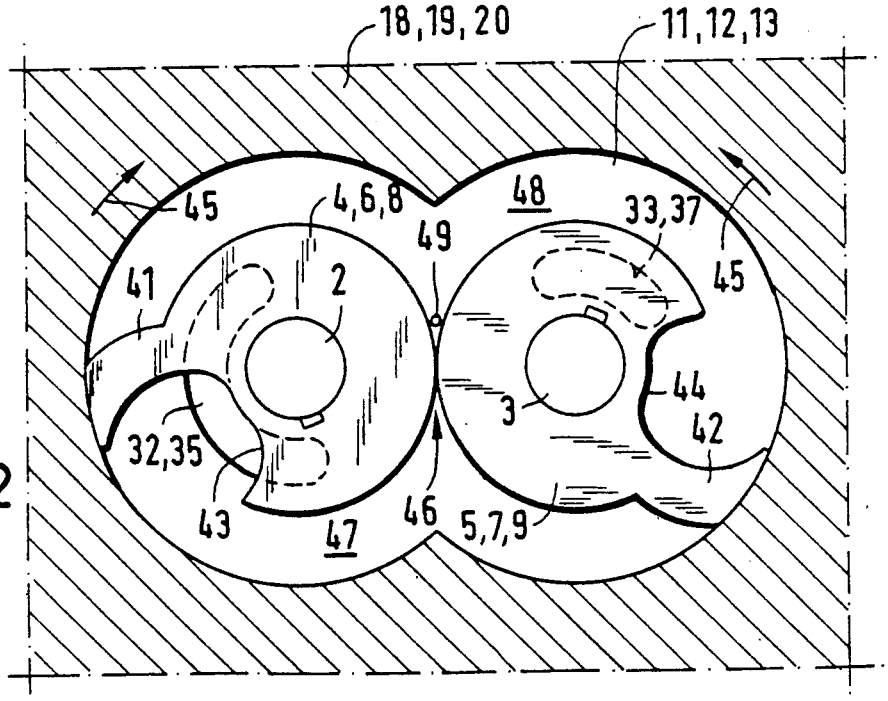
FIG.2

TWIN SHAFT VACUUM PUMP WITH PURGE GAS INLET

The invention is directed to a twin shaft vacuum pump with a claw rotor pair rotating in the pump chamber and forming a suction side and a delivery side in common with the walls of the chamber.

EU-A 87107089 discloses a twin shaft vacuum pump of this species. The rotors are each respectively equipped with a claw (tooth) and with a recess and execute their rotary motion in meshing and non-contacting fashion in the pump chamber. The respective recesses control the admission and discharge openings situated in the lateral shields of the pump chamber. During the synchronous rotary motion of the rotors, spaces sealed by gap openings that initially enlarge and then in turn diminish are formed, these compressing the gas that is flowed in at the suction side and conveying it to the delivery side.

The significant advantage of twin shaft vacuum pumps of the described species is that they can be operated dry, i.e. without sealants in the pump chamber. Pumps of this species are therefore frequently utilized for evacuating vacuum chambers in which etching, coating or other vacuum treatment or manufacturing methods are carried out. There is the risk in such employments that solids can proceed into the pump, namely, directly, i.e. that solids particles are formed initially during the compression of the gases, i.e. during the passage of the delivery gases through the vacuum pump. Examples of this are the creation of aluminum chloride in aluminum etching, ammonium chloride in coating processes, etc.

Solids that proceed directly or indirectly into the vacuum pump settle in the pump chamber, on the peripheral surfaces of the rotors as well, where they initially constrict the gap situated between the rotors. Further deposits lead thereto that the rotors touch, this leading to the fact that the solids particles roll onto the rotor surfaces. When the deposits continue to increase, then the layer that has been rolled on thickens, so that a force that presses the rotors and, thus, the rotor shafts, apart arises. Particularly given continued growth of the rolled-on layer, this leads to bearing damage and, thus, to the failure of the pump.

In a twin shaft vacuum pump of the species initially cited, the object of the present invention is to prevent solids particles that proceed into the vacuum pump from depositing in the pump chamber.

This object is inventively achieved in that a flushing gas line discharges into the pump chamber at the delivery side. When a flushing gas is supplied via this flushing gas line during the operation of the pump, then gas eddies arising in the pump chamber prevent the settling of solids particles that proceed into the pump chamber. The quantity of delivered flushing gas need not be especially high since the ultimate pressure of the pump would otherwise be unnecessarily deteriorated. It is especially advantageous when the flushing gas is delivered at high speed, for example, via a nozzle. The solids particles held in suspension as a consequence of the arising eddy can then be conveyed to the next pump stage or to the discharge of the pump.

The flushing gas line is expediently situated in the immediate proximity of the gap seal of the two rotors. The peripheral surfaces of the two rotors that are in particular jeopardy are thereby kept free of deposits.

Further advantages and details of the invention shall be set forth with reference to exemplary embodiments shown in FIGS. 1 and 2. Shown therein are:

FIG. 1 a longitudinal section through a multi-stage pump of the invention; and FIG. 2 a section through one of the pump chambers parallel to a rotor pair.

The exemplary embodiment shown in FIG. 1 is a three-stage vacuum pump 1 having two shafts 2 and 3 as well as three rotor pairs 4, 5 or, respectively, 6, 7 or, respectively, 8, 9. The axial length of the rotors decreases from the suction side to the delivery side. The rotary pistons are of the claw type (see FIG. 2) and rotate in the pump chambers 11, 12, 13 that are formed by the shields 14–17 and by the housing rings 18–20.

The drive motor 22 is situated next to the vertically arranged pump housing. The shafts 2, 3 are equipped below the lower end shield 17 with gear wheels 23, 24 of identical diameter that serve for the synchronization of the motion of the rotor pairs 4, 5 and, respectively, 6, 7 and, respectively, 8, 9. The drive motor 22 also comprises a gear wheel 25 at its underside. The drive connection is produced by a further gear wheel 26 that is in engagement with the gear wheels 24 and 25.

The shafts 2, 3 are supported in the upper end shield 14 and the lower end shield !7 via rolling bearings 27. The upper end shield 14 is equipped with a horizontally arranged connecting flange 28 that forms the admission 29 of the pump. At its end face (opening 32), the admission channel 31 discharges into the pump chamber 11 in the first stage. The discharge opening of the first stage arranged at the end face is referenced 3 and leads into the connecting channel 34. The connecting channel 34 situated in the shield 15 is in communication with the admission opening 35 of the second stage. The end shield 16 is correspondingly fashioned. The discharge 36 is situated under the lowest (third) pump stage, this discharge 36 being in communication with the end-face discharge opening 37 in the lower end shield 17.

FIG. 2 reveals the contour of the rotors. Each respectively comprises a claw 41, 42 as well as a recess 43, 44 and each executes its rotary motion in accord with the arrows 45 in meshing and non-contacting fashion. The gap seal situated between the two rotors is referenced 46.

The control of the admission opening 32, 35 and of the discharge opening 33, 37 ensues via the respective recess 43, 44. In the illustrated position, the rotors form two spaces 47 and 48, whereof the enlarging space 47 is connected to the admission opening 32, 35. The space 47 therefore forms the suction side. The diminishing space 48 is connected with the discharge 33, 37 after a slight rotary motion. The space 48 thus forms the delivery side.

The orifice 49 of a flushing gas line (not shown in FIG. 2) is inventively situated at the delivery side 48. The orifice 49 is situated in the immediate proximity of the sealing gap 46 between the two rotors, so that this sealing gap is preferably kept free of solids particles.

FIG. 1 shows that a plurality of orifices 49 are allocated to the pump chambers 11, 12, 13. For example, two orifices 49 are situated in the pump chamber 12, namely, lying directly opposite one another in the respective lateral shields !5, 16. The desired effect of holding solids particles in suspension is thereby achieved in an especially beneficial way.

The orifices 49 are in communication with a flushing gas source 51, namely, via bores 52, 53 in the lateral shields 15, 16 and are in communication with the valve 55 via the line system 54 provided outside the pump. Nozzles 56, 57 are situated in the schematically shown bores 52, 53, these nozzles, first, serving the purpose of reducing the quantity of gas delivered and, second, serving the purpose of increasing the velocity of the gas. For example, nitrogen is a suitable flushing gas.

I claim:

1. A twin-shaft vacuum pump comprising the following:

a rotor pair mounted for rotation in a pump chamber together by at least one chamber wall, said rotor pair together with said at least one chamber wall defining a suction side and a delivery side of said pump chamber;

a flushing gas outlet orifice, adapted for connection to a flushing gas delivery line, disposed within said pump chamber at said delivery side of said pump;

wherein said pump comprises at least one lateral shield in which said orifice is disposed; and wherein said rotor pair defines a gap seal between individual rotors, and said orifice is immediately adjacent said gap seal.

2. A twin-shaft vacuum pump comprising the following:

a plurality of rotor pairs, each of which is mounted for rotation in a respective pump chamber defined by at least one chamber wall; each of said rotor pairs together with its associated at least one chamber wall defining a suction side and a delivery side of said respective pump chamber;

a plurality of flushing gas outlet orifices, each of which is adapted for connection to a flushing gas delivery line and disposed within said pump chambers at said delivery side thereof;

wherein said pump comprises a plurality of lateral shields separating said pump chambers from one another; and said orifices are disposed in said lateral shields; and wherein each of said rotor pairs defines a gap seal between individual rotors, and said orifices are disposed immediately adjacent said gap seal.

3. A pump according to claim 2, wherein two of said orifices are disposed opposite one another in one of said lateral shields.

4. A pump according to claim 2, wherein said orifices are adapted for connection to said flushing gas source via bores in said lateral shields.

5. A pump according to claim 4, wherein said bores comprise means for reducing the quantity, and increasing the velocity, of flushing gas delivered to said orifices.

* * * * *